US008118480B2

(12) United States Patent
Gigandet et al.

(10) Patent No.: US 8,118,480 B2
(45) Date of Patent: Feb. 21, 2012

(54) DRIVING AND TRANSMITTING ELEMENT FOR AN ESCAPEMENT, ROLLER TABLE AND ESCAPEMENT EQUIPPED WITH THEM, AND TIMEPIECE INCLUDING THEM

(75) Inventors: Christophe Gigandet, Le Locle (CH); Francisco Dias, Fleurier (CH); Armin Behrend, Les Verrières (CH)

(73) Assignee: Chopard Technologies SA, Fleurier (CH)

( * ) Notice: Subject to any disclaimer, the term of this patent is extended or adjusted under 35 U.S.C. 154(b) by 496 days.

(21) Appl. No.: 12/342,474

(22) Filed: Dec. 23, 2008

(65) Prior Publication Data

US 2009/0168611 A1 Jul. 2, 2009

(30) Foreign Application Priority Data

Dec. 28, 2007 (CH) ..... 2019/07

(51) Int. Cl.
*G04B 17/04* (2006.01)

(52) U.S. Cl. ..... 368/133; 368/175

(58) Field of Classification Search ..... 368/127–131, 368/133, 175

See application file for complete search history.

(56) References Cited

U.S. PATENT DOCUMENTS

| | | | | |
|---|---|---|---|---|
| 3,469,392 | A | 9/1969 | Tuetey | |
| 3,678,683 | A | 7/1972 | Cielaszyk | |
| 3,791,251 | A * | 2/1974 | Pohlmann | 368/130 |
| 6,554,468 | B1 * | 4/2003 | Manaka et al. | 368/127 |
| 7,572,050 | B2 * | 8/2009 | Bitterli et al. | 368/324 |
| 7,758,237 | B2 * | 7/2010 | Musy et al. | 368/177 |
| 7,950,847 | B2 * | 5/2011 | Zaugg et al. | 368/175 |
| 7,959,352 | B2 * | 6/2011 | Bonnet et al. | 368/319 |

FOREIGN PATENT DOCUMENTS

| | | |
|---|---|---|
| CH | 484 463 | 1/1970 |
| DE | 482913 | 9/1929 |
| FR | 2 067 206 | 8/1971 |

OTHER PUBLICATIONS

Search Report of European Patent Office regarding European Patent Application No. EP 07 02 5169, Sep. 19, 2008.

* cited by examiner

*Primary Examiner* — Sean Kayes
(74) *Attorney, Agent, or Firm* — Bacon & Thomas, PLLC

(57) ABSTRACT

The driving and transmitting element (10, 50) is in the form of a ring (20) having an outer face (32) from which a stud (40) extends radially. Application to a roller table (60, 70) of a lever escapement (80) for a timepiece (90) including such a driving and transmitting element (10, 50) for rotating the anchor (84) and for transmitting an impulse from the anchor (84) to the roller table (60, 70).

25 Claims, 3 Drawing Sheets

DRIVING AND TRANSMITTING ELEMENT FOR AN ESCAPEMENT, ROLLER TABLE AND ESCAPEMENT EQUIPPED WITH THEM, AND TIMEPIECE INCLUDING THEM

The present invention relates to horological movements, and more particularly to escapements. In particular, it aims at a driving and transmitting element, on the one hand for driving the escapement anchor turning together with the roller table driven onto the balance staff, and on the other hand for transmitting to the roller table an impulse coming from the anchor. It also aims at a roller table including such a driving and transmitting element. It further aims at an escapement provided with such a driving and transmitting element and/or with such a roller table. It finally aims at a timepiece including such a driving and transmitting element and/or such a roller table and/or such an escapement.

Conventionally, a lever escapement includes a simple or double roller table driven onto the balance staff. A roller pin is driven into the underside of the roller table; when a double roller table is present, it is driven into the underside of the large roller table. The roller pin is a part that generally consists of ruby or garnet and has the shape of an ellipse, crescent, or triangle which when installed cooperates with the anchor fork.

In the work of a conventional escapement, the balance staff turns in a direction and rotates the roller table. The roller pin driven into the roller table rotates with it and cooperates with one of the horns of the fork in order to set the anchor in rotary motion about the anchor axis. While the anchor is rotating, one of its pallets liberates a tooth of the escape wheel that starts rotating. While being liberated, this same tooth imparts to the anchor an impulse via the same pallet. The anchor fork while still in contact with the roller pin imparts its impulse to said roller pin. This then transmits its impulse to the roller table, which in its turn transmits the impulse to the balance staff onto which it is driven. The same functions happen in the reverse order while the balance staff rotates in the other direction.

Thus, the roller pin has a twofold function: on the one hand it rotates together with the roller table making the anchor rotate so as to liberate the escape wheel, and on the other hand it transmits an impulse from the anchor to the roller table. It thus has a function of rotary drive and a function of energy transmission.

For several years now, numerous parts of horological movements are made of silicon-based material offering a very good coefficient of friction without the need for lubrification. The escape wheel and the anchor are among the parts made of silicon-based material. It is desirable that the element driving the anchor be made of a silicon-based material as well, so that a full kinematic chain would become available that consists of silicon-based material and has the same coefficient of friction everywhere.

It is not possible, however, to make a conventional roller pin of silicon-based material. In fact, such materials are brittle, that is, lack a plastic domain and will thus not allow a pin of silicon-based material to be driven into a metal plate.

It is an aim of the present invention to propose a driving and transmitting element for an escapement that could fill the functions of rotating the anchor and of transmitting energy from the anchor to the roller table and to the balance staff when the escapement is in operation, and that could be made of a material on the basis of silicon or any other brittle material.

According to a first aspect, the invention relates to a driving and transmitting element for an escapement in a timepiece, said escapement including an escape wheel, an anchor and at least one roller table driven onto a balance staff, said driving and transmitting element being intended on the one hand to rotate said anchor when it rotates together with said roller table, and on the other hand to transmit an impulse from said anchor to said roller table. Said driving and transmitting element includes elastic clamping means adapted to operate within a clamping plane and intended while working to be arranged in such a way that said clamping plane be substantially perpendicular to said balance staff and include means of interaction extending from said clamping means and intended to interact with said anchor in order to drive it.

Particular embodiments of the driving and transmitting element are described herein. According to one of them, the elastic clamping means are a split ring, and the means of interaction are a stud radially extending from said ring.

According to a second aspect, the invention relates to a roller table for a lever escapement, said roller table including a central hole intended to be traversed by a balance staff in order to fasten said roller table rigidly to said balance staff. Said roller table includes a driving and transmitting element according to the first aspect of the invention, and holding means in order to maintain the angular position of said driving and transmitting element.

According to a particular embodiment, said roller table additionally includes a rim extending around said central hole.

According to a third aspect, the invention relates to a lever escapement of the type including an escape wheel, an anchor and at least one roller table that includes a driving and transmitting element according to the first aspect and/or a roller table according to the second aspect.

According to a fourth aspect, the invention relates to a timepiece and notably a watch including a driving and transmitting element according to the first aspect and/or a roller table according to the second aspect and/or a lever escapement according to the third aspect.

The invention will be understood more readily when reading the following detailed description of particular embodiments furnished by way of illustration but in no way limiting, while referring to the annexed drawings where:

Figure 3:
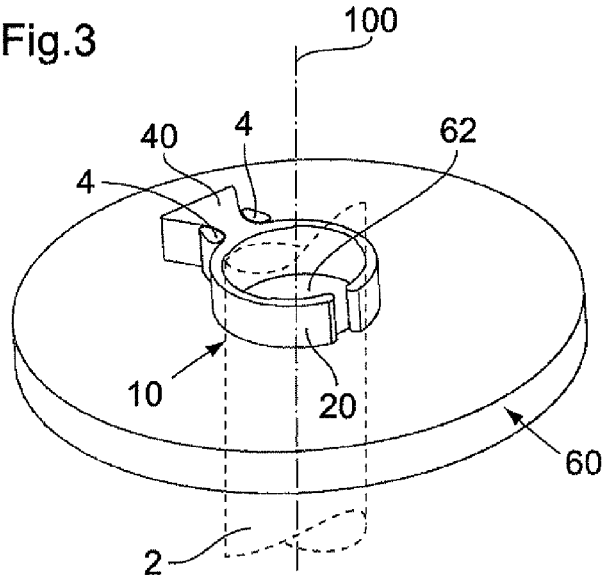
FIG. 3 represents a perspective view of a first embodiment of a roller table of an escapement having installed on it a driving and transmitting element according to the first embodiment, and shows a first embodiment of the holding means.
Figure 7:
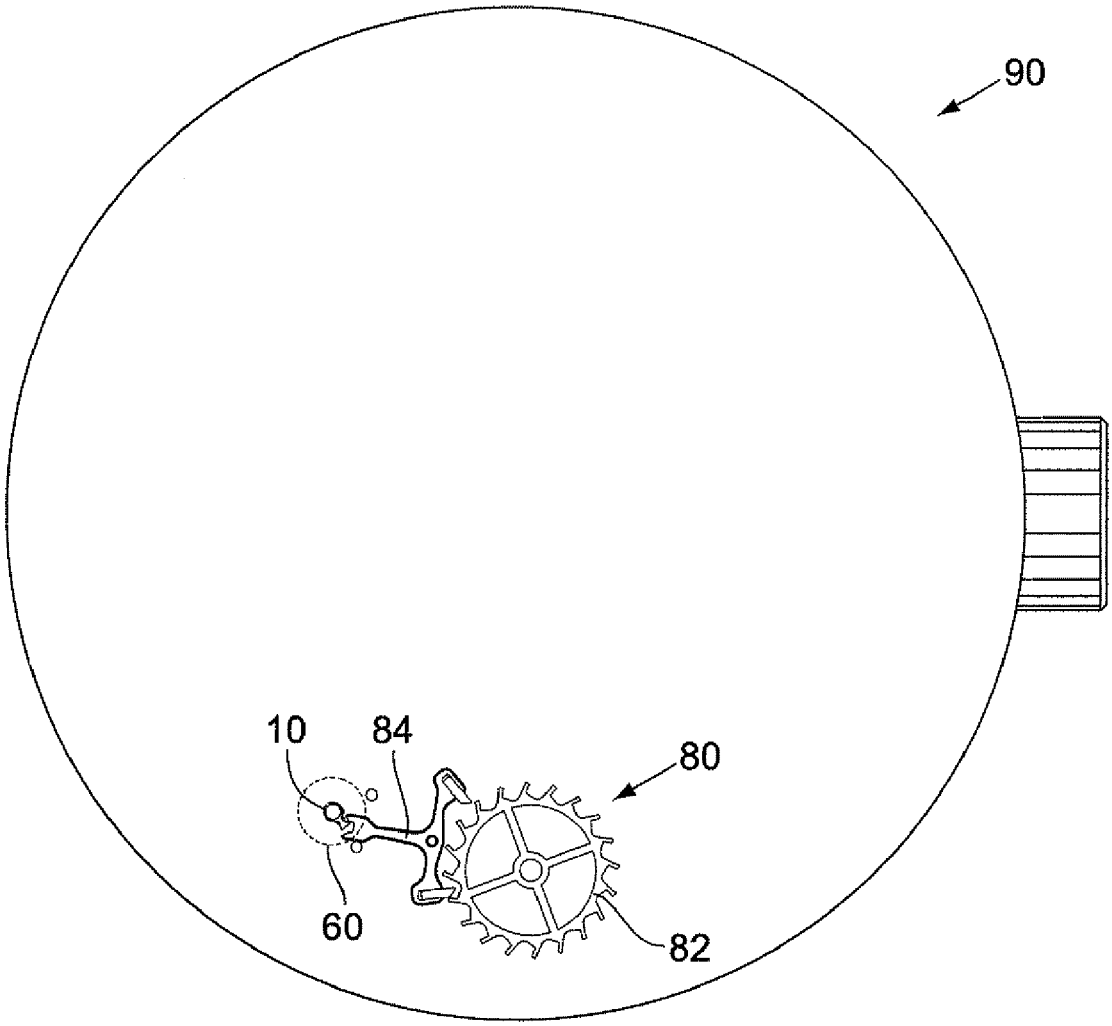

FIG. 7 schematically represents a watch provided with an escapement including the roller table and the driving and transmitting element of FIG. 3.

Figure 1:
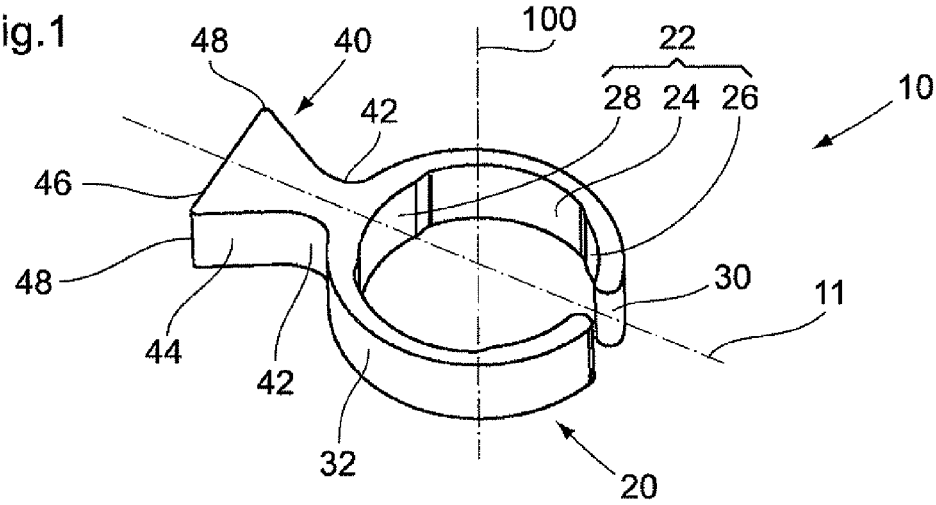
FIGS. 1 and 2 represent a first embodiment and a second embodiment of the driving and transmitting element in perspective views according to the first aspect of the invention.

Referring first of all to FIG. 1, a first embodiment of a driving and transmitting element 10 is represented that has elastic clamping means and means of interaction. The elastic clamping means are in the shape of a ring 20 having an axis 100, an inner face 22 and an outer face 32, and a slot 30 opening it. A stud 40 extends radially from said outer face 32 and diametrically opposite to slot 30. In the example illustrated, slot 30 is axial. It could be slanting. Slot 30 imparts elasticity to ring 20. Stud 40 and slot 30 define a first direction 11 of the driving and transmitting element 10 which together with the axis 100 of ring 20 forms a plane of symmetry for the driving and transmitting element 10. The plane of ring 20 that is perpendicular to axis 100 defines an elastic clamping plane. The inner face 22 of ring 20 includes two segments 26 next to the slot 30 and a segment 28 diametrically opposite to slot 30. It also includes two recessed segments 24, each of them situated between one of the segments 26 next to and the segment 28 opposite to the slot. The two recessed segments 24 are separated from axis 100 by a radius slightly larger than the common radius of the other three segments 26, 26, 28.

Stud 40 has a shape that widens from its end in contact with the outer surface 32 of ring 20 toward its free end. In the example illustrated, stud 40 has an substantially triangular profile, its free end having an end face 46 substantially plane and perpendicular to the first direction 11. Stud 40 has two lateral faces 44 linking the end face 46 with the outer face 32 of ring 20. The junction between each of the lateral faces 44 and the end face 46 consists of an edge 48 that preferably is slightly rounded.

Figure 2:
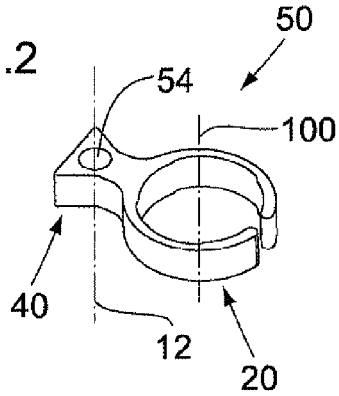

A second embodiment of a driving and transmitting element 50 is represented in FIG. 2. It differs from the first embodiment of the driving and transmitting element 10 in that stud 40 is provided with a through hole 54 that extends along a second direction 12 cutting the clamping plane of ring 20. The second direction 12 preferably is parallel to axis 100 of ring 20. The through hole 54 preferably is located in the vicinity of the free end of stud 40.

Stud 40 of the driving and transmitting element 50 according to the second embodiment may have lateral faces 42 that are recessed in a way similar to that of stud 40 of the driving and transmitting element 10 according to the first embodiment. This provides a shape that is generally the same in the driving and transmitting elements 10, 50 according to the two embodiments. It will thus be possible to implement common production steps for the two embodiments of the driving and transmitting elements 10, 50 while providing for an additional production step with which to realize the through hole 54 for the driving and transmitting element 50 according to the second embodiment.

In a way that is common to the two embodiments just described, the driving and transmitting elements 10, 50 are made of a material that has no plastic domain, for instance a silicon-based material. In the examples illustrated in FIGS. 1 and 2, ring 20 and stud 40 held by it consist of a single piece.

FIG. 3 illustrates a roller table 60 according to a first embodiment that is provided with a driving and transmitting element 10 according to the first embodiment. In known ways, roller table 60 has a central hole 62 by which when in the working position it is driven onto a balance staff 2 so that a rigid fastening of said roller table 60 to said balance staff 2 is produced. Ring 20 of the driving and transmitting element 10 is installed on roller table 60 around balance staff 2. In the figure, balance staff 2 is shown in broken lines in order to avoid that part of the ring 20 is hidden. Ring 20 is held in place by virtue of a slot 30 that is present so that an elastic clamping of balance staff 2 can be guaranteed in operation, and a potential sliding of ring 20 in the axial direction 100 can be avoided. Since the inner face 22 of ring 20 has two recessed segments 24, then the contact between this inner face 22 and balance staff 2 is established only over the three segments that are not recessed, that is, the two segments 26 next to slot 30 and the segment 28 diametrically opposite to slot 30. Such an arrangement with three contact regions serves to improve the elastic clamping action of ring 20 on the balance staff.

Figure 4:
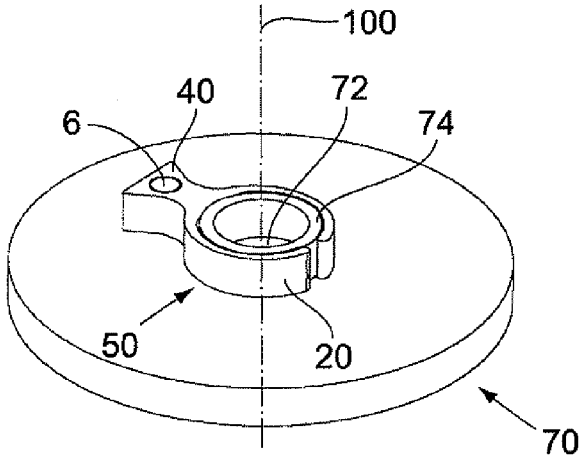
FIG. 4 represents a perspective view of a second embodiment of a roller table of an escapement having installed on it a driving and transmitting element according to the second embodiment, and shows a second embodiment of the holding means.

FIG. 4 illustrates a roller table 70 according to a second embodiment that is provided with a driving and transmitting element 50 according to the second embodiment. Similarly to roller table 60 according to the first embodiment, roller table 70 includes a central hole 72 by which it is driven onto the balance staff (not represented) when in the working position. In addition, roller table 70 includes an annular rim 74 that extends around the central hole 72 following a direction perpendicular to the plane of roller table 70. Rim 74 serves to increase the contact area between roller table 70 and the balance staff. Rim 74 also has a function of support for the driving and transmitting element 50. In fact, ring 20 of the driving and transmitting element 50 is installed on roller table 70 around rim 74. It is held in place by virtue of slot 30 securing its elastic clamping action while avoiding a potential sliding of ring 20 in the axial direction 100. Here again, the contact between the inner face 22 of ring 20 and the rim 74 occurs only along the three segments 26, 26, 28 that are not recessed. Such an arrangement with three contact regions serves to improve the elastic clamping of rim 74 by ring 20.

The angular position of the driving and transmitting elements 10, 50 is maintained by holding means 4, 4, 6 of roller tables 60, 70.

A first implementation of the holding means is illustrated in FIG. 3 relating to a roller table 60 according to the first embodiment and a driving and transmitting element 10 according to the first embodiment. Said holding means consist of two pegs 4, 4 fastened at the face of roller table 60 that receives the driving and transmitting element 10. Pegs 4, 4 are arranged on the face of roller table 60 in such a way that stud 40 is immobilized between them when ring 20 in the working position has been placed around balance staff 2. The lateral faces 42 of stud 40 are recessed in the region of contact with the two pegs 4, 4 so that said pegs 4, 4 will not interfere with the cooperation of the free end of stud 40 with the anchor while the escapement works, which will be described further down while referring to FIGS. 5 and 6. This first implementation of the holding means is compatible as well with a roller table 70 according to the second embodiment, even though such a variant has not been represented in the figures for the sake of simplicity. In this case ring 20 in its working position would be immobilized by pegs 4, 4 against the rim 74 of roller table 70.

A second implementation of the holding means that is particularly adapted to the driving and transmitting element 50 according to the second embodiment is illustrated in FIG. 4 relating to a roller table 70 according to the second embodiment. Said holding means consist of a single peg 6 fastened to the face of roller table 70 receiving the driving and transmitting element 50. Peg 6 is arranged in such a way on the face of roller table 70 that stud 40 will be immobilized by insertion of this peg 6 into the through hole 54 when ring 20 in its working position has been placed around rim 74 of roller table 70. The diameter of peg 6 is adjusted to the diameter of the through hole 54 in such a way that peg 6 will not constrain stud 40 of the driving and transmitting element 50. This implementation of the holding means is again compatible with a roller table 60 according to the first embodiment, even though such a variant has not been represented in the figures for the sake of simplicity. In this case ring 20 in its working position would be immobilized by peg 6, directly against balance staff 2.

In a manner that is common to the two embodiments of roller tables 60, 70 just described, roller tables 60, 70 preferably are made of metal, for example steel or nickel. Roller tables 60 and 70 as well as pegs 4, 4, 6 preferably are realized in monoblock fashion. More preferably yet, pegs 4, 4, 6 are obtained by galvanic growth using a process known under the name of LIGA.

Figure 5:
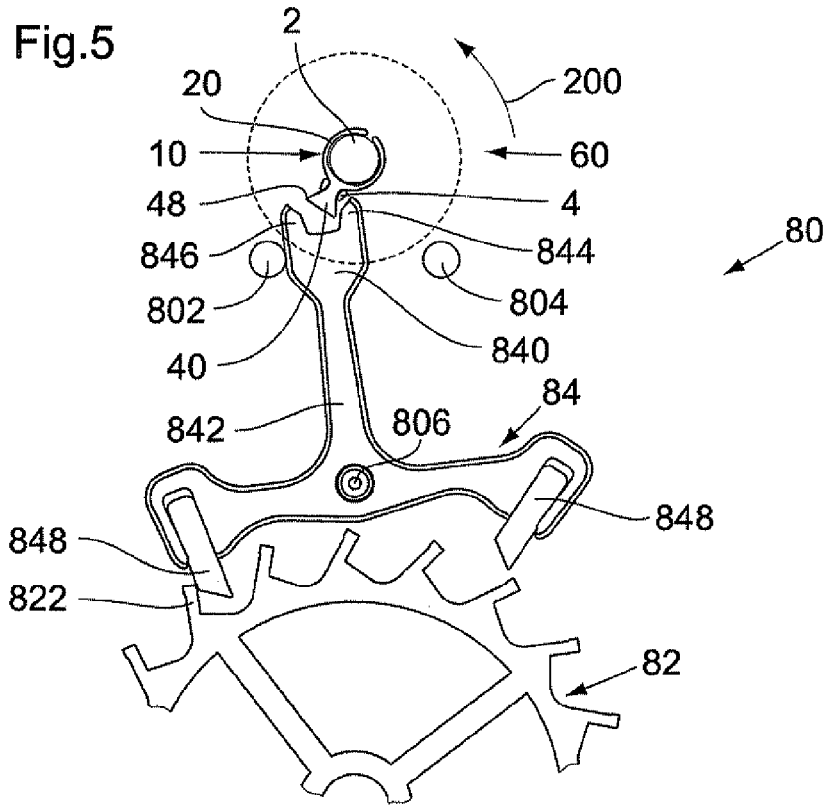
FIGS. 5 and 6 illustrate two working positions of an escapement seen from the front that show the cooperation of the escapement anchor with the roller table and with the driving and transmitting element of FIG. 3.
Figure 6:
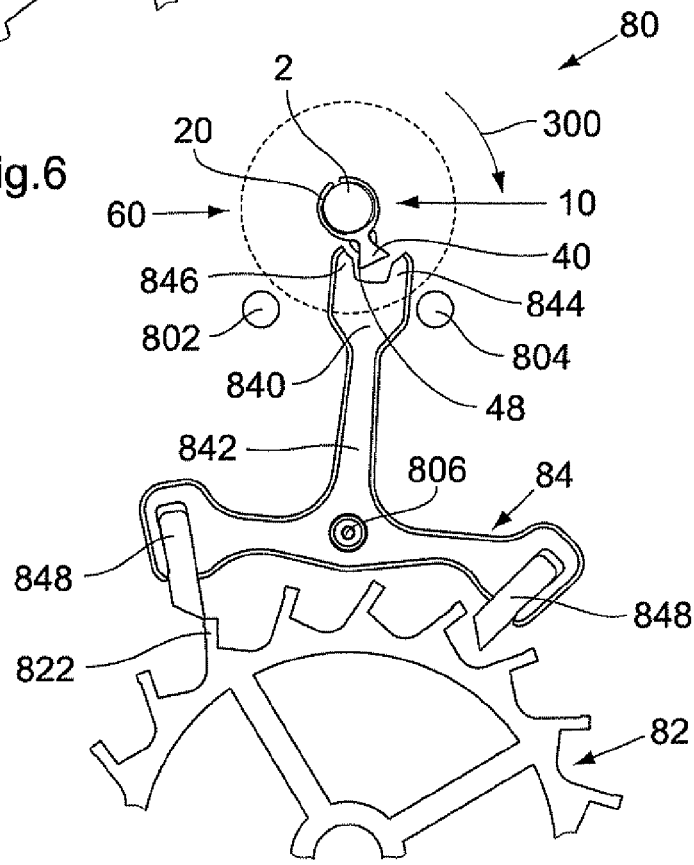

FIGS. 5 and 6 illustrate two configurations of an operating escapement according to a third aspect of the invention. They show a lever escapement 80 which in known manner comprises an escape wheel 82 provided with teeth 822 and an anchor 84 capable of rotating about an anchor axis 806. The oscillatory motion of anchor 84 about anchor axis 806 is limited by two stops 802, 804. In known manner, anchor 84 includes a dart that is not represented in order to simplify the figure, and a fork 840 held by a lever 842. Fork 840 of anchor 84 includes two horns 844, 846, while the other end of anchor 84 includes two pallets 848.

In addition, escapement 80 includes a roller table 60 according to the first embodiment driven onto a balance staff 2 and provided with a driving and transmitting element 10 according to the first embodiment that includes a ring 20 and a stud 40 immobilized on roller table 60 by two pegs 4, 4 as described while referring to FIG. 3.

FIGS. 5 and 6 are seen in section along the plane of contact between roller table 60 and the driving and transmitting element 10. Thus, roller table 60 is represented in broken lines allowing a simplification of the figures.

In FIG. 5, balance staff 2 rotates in the direction indicated by arrow 200. Roller table 60 driven onto balance staff 2 rotates in the same direction. The driving and transmitting element 10 that has been immobilized on roller table 60 by means of pegs 4, 4 rotates with it until encountering one 844 of the horns 844, 846 of fork 840 and causing it to rotate, which produces a rotation of anchor 84 about anchor axis 806. In its rotation, one 848 of the pallets of anchor 84 liberates tooth 822, which allows the escape wheel 82 to rotate. While being liberated, tooth 822 transmits an impulse coming from the escape wheel 82 to anchor 84, which via the driving and transmitting element 10 transmits it to the roller table 60 and to the balance staff 2 onto which said roller table 60 is driven.

In FIG. 6, balance staff 2 rotates in the direction indicated by arrow 300 while stud 40 cooperates with the other horn 846 of fork 840. A movement results that is comparable to that just described while referring to FIG. 5.

In both cases, the cooperation between stud 40 and each of the horns 844, 846 of fork 840 is realized via the edges 48 of stud 40. The contact between edges 48 and horns 844, 846 is improved when they are slightly rounded.

When escapement 80 is functioning, stud 40 of the driving and transmitting element 10 advantageously fills the classical functions of roller pin of a conventional escapement.

FIG. 7 illustrates in a schematic manner a timepiece 90, typically a watch, that is provided with an escapement 80 such as just described while referring to FIGS. 5 and 6 and including an escape wheel 82, an anchor 84, a roller table 60, and a driving and transmitting element 10.

While not shown in FIGS. 5, 6, 7, the escapement 80 and timepiece 90 according to the invention could include a roller table 60 according to the first embodiment and provided with a driving and transmitting element 50 according to the second embodiment, or also a roller table 70 according to the second embodiment and provided with a driving and transmitting element 10 according to the first embodiment, or even a roller table 70 according to the second embodiment and provided with a driving and transmitting element 50 according to the second embodiment.

It is understood that the invention is not limited to the embodiments that have been illustrated in the figures but covers variant embodiments within the capacity of one skilled in the arts. For example, the end face 46 of stud 40 of the driving and transmitting element could be concave or convex, instead of plane. For example, the elastic clamping means could have a form different from that of a split ring, and clamping could be realized over two rather than three points.

The invention claimed is:

1. A driving and transmitting element for an escapement of a timepiece, said escapement comprising:

an escape wheel, an anchor, and a balance shaft, said driving and transmitting element being arranged, when incorporated in said escapement, to rotate said anchor when the driving and transmitting element rotates together with said balance shaft, and to transmit an impulse from said anchor to said balance shaft, said driving and transmitting element comprising:

an elastic clamp adapted to operate within a clamping plane and arranged, when said driving and transmitting element is incorporated in said escapement, so that said clamping plane is substantially perpendicular to said balance shaft, and an interaction device extending from said clamp, for interacting with said anchor, wherein said driving and transmitting element is formed as a single piece made of a brittle material.

2. The driving and transmitting element according to claim 1, wherein said clamp is in the form of an elastic ring.

3. The driving and transmitting element according to claim 2, wherein said ring has a slot opening.

4. The driving and transmitting element according to claim 3, said ring having an axis and wherein said slot and said interaction device are on diametrically opposite sides of said axis.

5. The driving and transmitting element according to claim 4, wherein said ring comprises an inner face having two recessed segments, and wherein each recessed segment is situated between said slot and said interaction device.

6. The driving and transmitting element according to claim 2, wherein said ring comprises an inner face having two recessed segments.

7. The driving and transmitting element according to claim 1, wherein said interaction device has a shape that becomes wider with increasing distance from said clamp.

8. The driving and transmitting element according to claim 1, wherein said interaction device comprises a through hole extending along a direction intersecting said clamping plane.

9. The driving and transmitting element according to claim 1, wherein said brittle material is a silicon-based material.

10. A driving and transmitting element for an escapement of a timepiece, said escapement comprising:

an escape wheel, an anchor, and a balance shaft, said driving and transmitting element being arranged, when incorporated in said escapement, to rotate said anchor when the driving and transmitting element rotates together with said balance shaft, and to transmit an impulse from said anchor to said balance shaft, said driving and transmitting element comprising:

an elastic clamp adapted to operate within a clamping plane and arranged, when said driving and transmitting element is incorporated in said escapement, so that said clamping plane is substantially perpendicular to said balance shaft, and an interaction device extending from said clamp, for interacting with said anchor, wherein said clamp is in the form of an elastic ring having a slot opening, and wherein said slot and said interaction device are on diametrically opposite sides of an axis of said ring.

11. The driving and transmitting element according to claim 10, wherein said ring comprises an inner face having two recessed segments.

12. The driving and transmitting element according to claim 11, wherein each recessed segment is situated between said slot and said interaction device.

13. A driving and transmitting element for an escapement of a timepiece, said escapement comprising:

an escape wheel, an anchor, and a balance shaft, said driving and transmitting element being arranged, when incorporated in said escapement, to rotate said anchor when the driving and transmitting element rotates together with said balance shaft, and to transmit an impulse from said anchor to said balance shaft, said driving and transmitting element comprising:

an elastic clamp adapted to operate within a clamping plane and arranged, when said driving and transmitting element is incorporated in said escapement, so that said clamping plane is substantially perpendicular to said balance shaft, and an interaction device extending from said clamp, for interacting with said anchor, wherein said clamp is in the form of an elastic ring, and wherein said ring comprises an inner face having recessed segments.

14. An escapement for a timepiece, comprising:

an escape wheel, an anchor, a balance shaft, a roller table fastened on said balance shaft, and a driving and transmitting element arranged to rotate said anchor when the driving and transmitting element rotates together with said roller table, and to transmit an impulse from said anchor to said roller table, said driving and transmitting element comprising:

an elastic clamp adapted to operate within a clamping plane that is substantially perpendicular to said balance shaft, and an interaction device extending from said clamp, for interacting with said anchor, wherein said roller table comprises a holding device arranged to maintain an angular position of said driving and transmitting element with respect to said roller table.

15. The escapement according to claim 14, wherein said driving and transmitting element is formed as a single piece made of a brittle material.

16. The escapement according to claim 15, wherein said brittle material is a silicon-based material.

17. The escapement according to claim 14, wherein said clamp is in the form of an elastic ring having a slot opening, and wherein said slot and said interaction device are on diametrically opposite sides of an axis of said ring.

18. The escapement according to claim 17, wherein said ring comprises an inner face having two recessed segments, and wherein each recessed segment is situated between said slot and said interaction device.

19. The escapement according to claim 14, wherein said clamp is arranged around said balance shaft.

20. The escapement according to claim 14, wherein said roller table comprises a central hole traversed by said balance shaft and a rim extending around said central hole.

21. The escapement according to claim 20, wherein said elastic clamp exerts an elastic clamping action on the rim of said roller table.

22. The escapement according to claim 14, wherein said holding device comprises two pegs fastened to the roller table in such a way that the interaction device of said driving and transmitting element is immobilized between said pegs.

23. The escapement according to claim 14, wherein said holding device comprises a peg fastened to the roller table in such a way that the interaction device of said driving and transmitting element is immobilized by said peg being inserted into a through hole of said interaction device.

24. The escapement according to claim 14, wherein said holding device is formed as a single piece with said roller table.

25. The escapement according to claim 14, wherein said elastic clamp exerts an elastic clamping action on said balance shaft.

* * * * *